United States Patent [19]

Taguchi

[11] Patent Number: 4,726,797

[45] Date of Patent: Feb. 23, 1988

[54] TILT POSITION HOLDING DEVICE FOR OUTBOARD MOTOR

[75] Inventor: Michihiro Taguchi, Hamamatsu, Japan

[73] Assignee: Sanshin Kogyo Kabushiki Kaisha, Japan

[21] Appl. No.: 910,130

[22] Filed: Sep. 22, 1986

[30] Foreign Application Priority Data

Sep. 24, 1985 [JP] Japan ..... 60-208590

[51] Int. Cl.[4] ..... B63H 21/26

[52] U.S. Cl. ..... 440/63; 248/642

[58] Field of Search ..... 440/55, 63; 248/642, 248/643

[56] References Cited

U.S. PATENT DOCUMENTS

| | | | |
|---|---|---|---|
| 3,018,989 | 1/1962 | Gossett | 248/642 |
| 3,576,173 | 4/1971 | Ginnow | 440/55 |
| 4,168,818 | 9/1979 | Ellis | 440/55 |
| 4,402,675 | 9/1983 | Eichinger | 248/643 |

FOREIGN PATENT DOCUMENTS

| | | | |
|---|---|---|---|
| 53-93595 | 8/1978 | Japan | 440/63 |
| 57-44597 | 3/1982 | Japan | 440/63 |
| 2035934 | 6/1980 | United Kingdom | 440/63 |

*Primary Examiner*—Sherman D. Basinger
*Assistant Examiner*—Thomas J. Brahan
*Attorney, Agent, or Firm*—Ernest A. Beutler

[57] ABSTRACT

An improved tilt holding mechanism for an outboard drive including a pair of tilt holding members that are pivotally supported and connected to each other by a common interconnecting shaft arrangement. An over-center biasing spring is provided for biasing the tilt locking members to both their released positions and their operative positions.

5 Claims, 3 Drawing Figures

TILT POSITION HOLDING DEVICE FOR OUTBOARD MOTOR

BACKGROUND OF THE INVENTION

This invention relates to a tilt position holding device for an outboard motor and more particularly to an improved and simplified tilt position holding device for such an application.

It is well known that marine outboard drives such as outboard motors are supported for tilting movement about a horizontally extending tilt axis. This movement is incorporated in an outboard motor so as to permit the outboard motor to be tilted up from a normal running condition to a raised, out of the water position for trailering, storage, service, etc. Some form of tilt position holding device or locking device is normally incorporated so as to hold the outboard motor in its tilted up position. Such tilt locking devices normally include a pair of pivotally supported levers at the opposite side of the outboard motor which cooperate between the swivel bracket and the clamping bracket and are movable between a release position and an engaged position wherein the outboard motor will be held in its tilted up position. The levers are interconnected by means of a control link that extends either forwardly or rearwardly of the swivel bracket so that they will operate in unison and an over-center spring arrangement is employed for retaining the levers in their locking and released positions. Although this type of device is extremely satisfactory, the interconnecting rod between the two levers protrudes either forwardly or rearwardly and occupies considerably space. In addition, the rod may be exposed so that it could be damaged and operation will then become difficult.

It is, therefore, a principal object of this invention to provide a tilt holding device for an outboard drive that is simple and yet highly effective.

It is a further object of this invention to provide an improved and simplified tilt holding device for an outboard drive.

It is a yet further object of this invention to provide a compact, reliable and highly effective tilt holding device for an outboard drive.

SUMMARY OF THE INVENTION

This invention is adapted to be embodied in a tilt locking device for an outboard drive that comprises a swivel bracket carrying the outboard drive for steering movement about a generally vertically extending steering axis and a supporting bracket comprised of a pair of transversely spaced members that are adapted to be affixed to the transom of an associated watercraft. Tilt pivot means pivotally connect the swivel bracket to the support bracket for pivotal movement of the swivel bracket and associated outboard drive about a generally horizontally extending tilt axis. In accordance with the invention, a pair of spaced apart tilt locking members are incorporated and pivot shaft means pivotally support the tilt locking members upon one of the brackets and interconnect the tilt locking members for simultaneous movement between a released position and an engaged position for cooperation with the other of the brackets for retaining the swivel bracket and outboard drive in a tilted up position.

DETAILED DESCRIPTION OF THE PREFERRED EMBODIMENT

Figure 1:
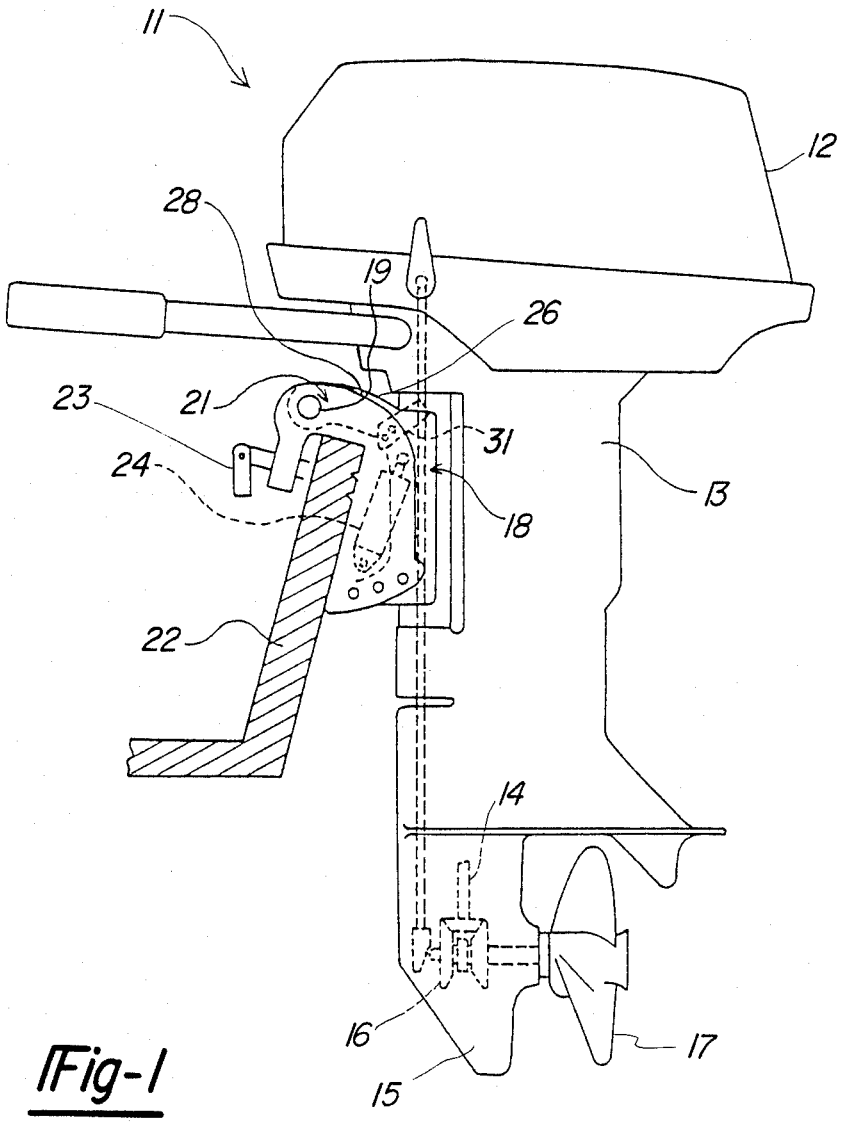
FIG. 1 is a side elevational view of an outboard motor, attached to the transom of an associated watercraft, shown in section, and embodying a tilt position holding device constructed in accordance with an embodiment of the invention.
Figure 2:
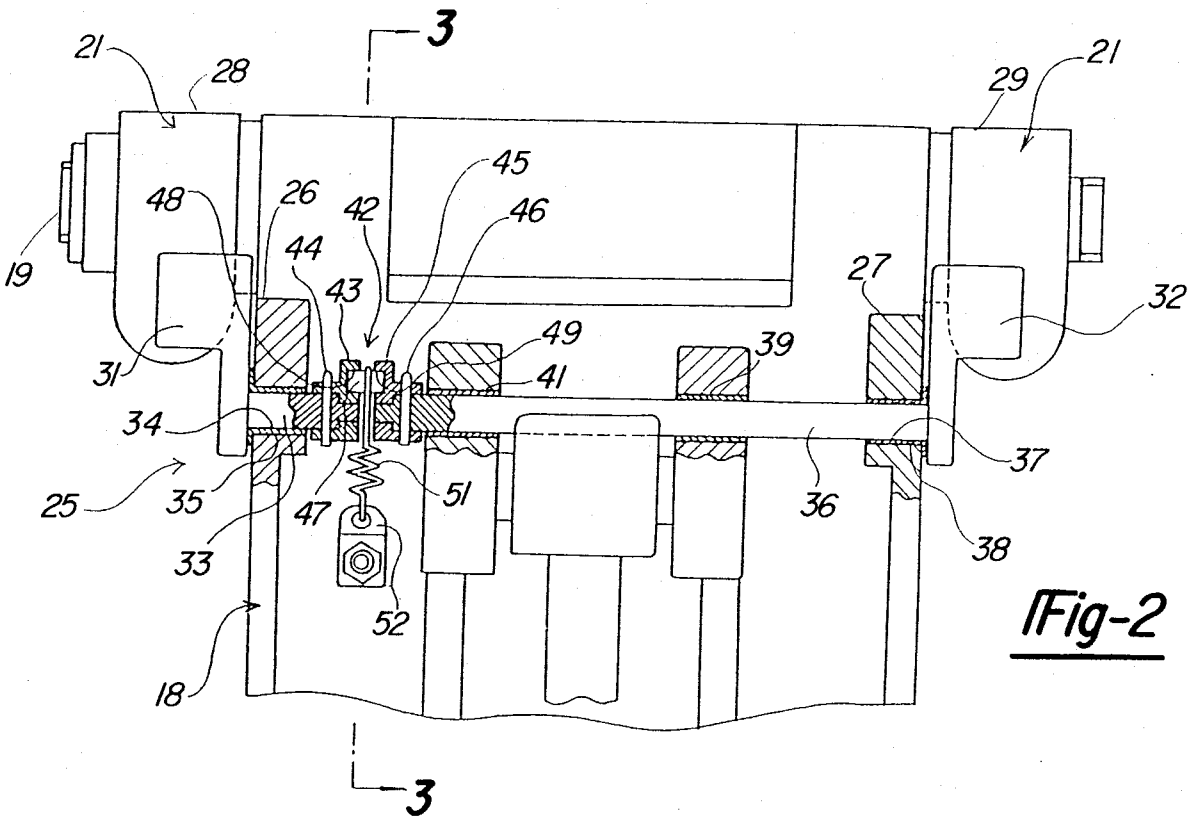
FIG. 2 is an enlarged rear elevational view, with portions broken away and shown in section, of the tilt holding device and its association with the outboard motor.

An outboard motor constructed in accordance with an embodiment of the invention is identified generally by the reference numeral 11 and includes a power head 12 that contains an internal combustion engine (not shown) that is contained within an outer protective cowling. The engine of the power head 12 drives a drive shaft 14 that extends through and is journaled within a drive shaft housing 13. The drive shaft 14 terminates within a lower unit 15 wherein a forward, neutral, reverse transmission 16 is provided for driving a propeller 17 in a known manner. The construction of the outboard motor 11 forms no part of the invention and, for that reason, it has not been described in further detail.

A steering shaft (not shown) is affixed to the drive shaft housing 13 in a known manner and is journaled within a swivel bracket 18 for steering of the outboard motor 11 about a generally vertically extending steering axis. The swivel bracket 18 is, in turn, pivotally connected by means of a pivot pin 19 to a clamping bracket assembly 21 for tilting movement of the outboard motor 11 about a horizontally extending axis defined by the pivot pin 19. The clamping bracket 21 is, in turn, affixed to a transom 22 of an associated watercraft in a known manner, as by means of clamping screws 23.

A hydraulic cylinder assembly 24 is connected between the clamping bracket 21 and the swivel bracket 18. The hydraulic cylinder assembly 24 may comprise a hydraulic shock absorber for permitting the outboard motor 11 to pop up when an underwater obstacle is struck and then to return slowly to its normal running condition once the underwater obstacle has been cleared. The hydraulic cylinder 24 may also include a fluid motor so as to permit fluid power trim adjustment and powered tilting up of the outboard motor 11.

A tilt position holding device, indicated generally by the reference numeral 25, is provided for blocking the outboard motor 11 in its tilted up position. It should be noted that the swivel bracket 18 includes a pair of spaced apart side members 26 and 27 that are juxtaposed to corresponding side members 28 and 29 of the clamping bracket 21.

A first lock generally L-shaped locking or holding lever 31 is associated with the swivel bracket member 26 and clamping bracket member 28 for selectively holding the outboard motor 11 in its upward position. A similar locking lever 32 is associated with the swivel bracket member 27 and clamping bracket member 29 for the same purpose. The locking lever 31 is affixed to a shaft 33 which is, in turn, journaled within a bore 34 of an anti-fraction bushing 35 that is supported within the member 26 for rotatably supporting the locking lever for movement between a locked position and a released position. In a similar manner, the lever 32 has affixed to it a shaft 36 that is journaled in a bore 37 of a bushing 38 that is carried by the swivel bracket member 27. It should be noted that the shaft 36 is substantially longer than the shaft 33 and is also journaled in intermediate bushings 39 and 41 carried by further components of the swivel bracket 18. The shafts 33 and 36 terminate closely adjacent each other and adjacent to the swivel member 26.

The shafts 33 and 36, accordingly, the levers 31 and 32 are connected for simultaneous rotation by means of a crank shape member, indicated generally by the reference numeral 42. The crank shape member 42 is comprised of a first portion 43 that has a counterbore which receives a complementary shaped end of the shaft 33 and which is affixed against rotation relative to the shaft 33 by means of a pin 44. In a similar manner, a second portion 45 has a complementary counterbore that receives an end of the shaft 36 and which is affixed against rotation relative to the shaft 36 by means of a pin 46. The portions 43 and 45 are connected for simultaneous rotation by means of an interconnecting pin 47 that is received in complementary bores 48 and 49 of the members 43 and 45 which bores are offset from the axis of rotation of the shafts 33 and 36.

One end of a tension spring 51 is affixed to the pin 47. The opposite end of the spring 51 is connected to a bracket 52 that is carried by the swivel bracket 18. The spring 51 acts on the pin 47 so as to urge the shafts 33 and 36 and levers 31 and 32 to either a released position against a first stop surface 53 of a stop member 54 or to an engaged position against a second stop surface 55 of the member 54. These positions extend over center of a center line 56 that extends between the axis of the shafts 33 and 36 and the center of the spring supporting bracket 52.

Figure 3:
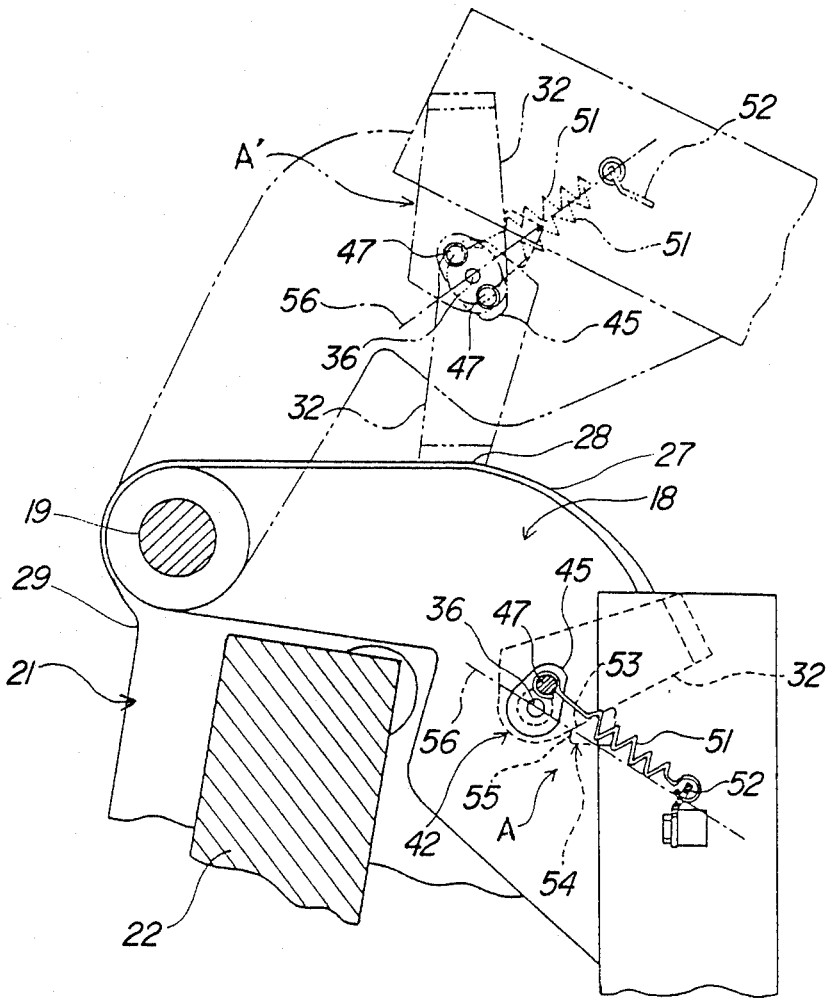
FIG. 3 is a cross-sectional view taken along the line 3—3 of FIG. 2 showing the outboard motor in its tilted down position in solid line view in its tilted up position in phantom line views. The tilt holding device is shown in its released position in the tilted down condition and in both its released and its engaged position in the tilted up position.

Referring specifically to FIG. 3, the solid line view shows the outboard motor 11 in its tilted down position and with the locking mechanism 25 in its released position. In this position, the spring 35 urges the levers 31 and 32 against the stop surface 53 and holds the mechanism in its released position. This position is shown by the view A. When the outboard motor 11 is tilted up, the tilt holding mechanism 25 is still in its released position as shown in the position A'. In order to place the tilt holding mechanism 25 in its operative position, it is rotated by grasping either of the levers 31 or 32 and rotating them in a counterclockwise direction as seen in FIG. 3 to the locked position B. When this occurs, the spring 51 will move over center of the line 56 and now will urge the tilt locking levers 31 and 32 against the surface 55 so as to hold the locking levers 31 and 32 in their locked position. The outboard motor 11 may then be lowered slightly so that the ends of the levers 31 and 32 will engage the clamping bracket members 28 and 29 and restrain the outboard motor 11 in its tilted up position.

In order to again lower the outboard motor 11, it is raised slightly and the locking mechanism comprised of the levers 31 and 32 is rotated in a clockwise direction to return it to its released position A' so that the outboard motor 11 may again be returned to its normal tilted down running condition.

It should be readily apparent from the foregoing description that a highly effective and yet simple and compact tilt holding mechanism has been illustrated and described. It is to be understood that the foregoing description is that of a preferred embodiment of the invention and that various changes and modifications may be made without departing from the spirit and scope of the invention, as defined by the appended claims.

I claim:

1. In a tilt locking device for an outboard drive comprising a swivel bracket carrying said outboard drive for steering movement about a generally vertically steering axis, a supporting bracket comprising a pair of transversely spaced members adapted to be affixed to the transom of an associated watercraft, tilt pivot means pivotally connecting said swivel bracket to said supporting bracket for pivotal movement of said swivel bracket and said outboard drive about a generally horizontally extending tilt axis, the improvement comprising a pair of spaced apart tilt locking members and first and second pivot shaft means respectively pivotally supporting said tilt locking members upon a respective one of said brackets and a crank member means interconnecting said first and second pivot shafts and said tilt locking members for simultaneous movement between a released position and an operative position for cooperation with the other of said brackets for retaining said swivel bracket and said outboard drive in a tilted up position said crank member comprising a first member affixed to said first pivot shaft, a second member affixed to said second pivot shaft and an eccentric pin coupling said first member and said second member to each other.

2. In a tilt locking device as set forth in claim 1 further including biasing means operating on said crank member.

3. In a tilt locking device as set forth in claim 2 wherein the biasing means biases the tilt locking members to each of their released and operative positions by means of an over-center relationship.

4. In a tilt locking device as set forth in claim 3 wherein the pivot shaft means pivotally supports the tilt locking members on the swivel bracket.

5. In a tilt locking device as set forth in claim 1 wherein the pivot shaft means pivotally supports the tilt locking members on the swivel bracket.

* * * * *